US005879222A

United States Patent [19]

Robinson

[11] Patent Number: 5,879,222

[45] **Date of Patent: *Mar. 9, 1999**

[54] ABRASIVE POLISHING PAD WITH COVALENTLY BONDED ABRASIVE PARTICLES

[75] Inventor: Karl M. Robinson, Boise, Id.

[73] Assignee: Micron Technology, Inc., Boise, Id.

[ * ] Notice: The term of this patent shall not extend beyond the expiration date of Pat. No. 5,624,303.

[21] Appl. No.: 838,394

[22] Filed: Apr. 9, 1997

Related U.S. Application Data

[63] Continuation-in-part of Ser. No. 589,774, Jan. 22, 1996, Pat. No. 5,624,303.

[51] Int. Cl.[6] ..... B24B 5/00

[52] U.S. Cl. ..... 451/41; 451/285; 451/921; 451/526; 451/532; 51/293; 51/298; 51/306

[56] References Cited

U.S. PATENT DOCUMENTS

| | | | |
|---|---|---|---|
| 3,617,347 | 11/1971 | Kuratomi | 117/69 |
| 4,565,771 | 1/1986 | Lynch et al. | 430/307 |
| 4,954,142 | 9/1990 | Carr et al. . | |
| 5,127,196 | 7/1992 | Morimoto et al. | 51/165.73 |
| 5,197,999 | 3/1993 | Thomas | 51/298 |
| 5,213,588 | 5/1993 | Wong et al. | 51/293 |
| 5,250,085 | 10/1993 | Mevissen | 51/298 |
| 5,433,650 | 7/1995 | Winebarger | 451/6 |
| 5,624,303 | 4/1997 | Robinson | 451/921 |

FOREIGN PATENT DOCUMENTS

| | | |
|---|---|---|
| 0227394 | 7/1987 | European Pat. Off. . |
| 02186656 | 7/1990 | European Pat. Off. . |
| 07135192 | 5/1995 | European Pat. Off. . |
| 0685877A2 | 12/1995 | European Pat. Off. . |
| WO94/04599 | 3/1994 | WIPO . |

*Primary Examiner*—Robert A. Rose
*Assistant Examiner*—George Nguyen
*Attorney, Agent, or Firm*—Seed and Berry, LLP

[57] ABSTRACT

The inventive polishing pad is used for planarizing semiconductor wafers or other substrates with a mechanical or CMP process; the polishing pad preferably has a body made from a matrix material, bonding molecules bonded to the matrix material, and abrasive particles bonded to the bonding molecules in a manner that affixes the abrasive particles to the matrix material and substantially maintains the affixation between the matrix material and the abrasive particles in the presence of an electrostatic CMP slurry or other planarizing solution. The bonding molecules are preferably covalently attached to the matrix material and substantially all of the abrasive particles are preferably covalently bonded to at least one bonding molecule. The bonding molecules securely affix the abrasive particles to the matrix material to preferably enhance the uniformity of the distribution of the abrasive particles throughout the pad and to substantially prevent the abrasive particles from detaching from the pad during planarization.

80 Claims, 4 Drawing Sheets

ABRASIVE POLISHING PAD WITH COVALENTLY BONDED ABRASIVE PARTICLES

CROSS-REFERENCE TO PRIOR APPLICATION

This application is a continuation-in-part of U.S. patent application Ser. No. 08/589,774, filed Jan. 22, 1996, U.S. Pat. No. 5,624,303, and entitled POLISHING PAD AND METHOD FOR MAKING A POLISHING PAD WITH COVALENTLY BONDED PARTICLES.

TECHNICAL FIELD

The present invention relates to polishing pads used in mechanical and chemical-mechanical planarization of semiconductor wafers and other substrates, and more particularly to polishing pads with abrasive particles bonded to a matrix material to form an abrasive polishing pad.

BACKGROUND OF THE INVENTION

Chemical-mechanical planarization ("CMP") processes remove material from the surface of substrates, such as field emission displays and semiconductor wafers. CMP processing, for example, is extensively used to form structures and create flat surfaces in the production of ultra-high density integrated circuits on semiconductor wafers. In a typical CMP process, a wafer is pressed against a non-abrasive polishing pad in the presence of an abrasive slurry under controlled chemical, pressure, velocity, and temperature conditions. The abrasive slurry solutions generally have abrasive particles and chemicals to remove material from the substrate surface. Thus, when relative motion is imparted between the substrate and the pad, the slurry solution removes material from the surface of the substrate.

CMP processes must consistently and accurately produce a uniform, planar surface on the wafer because it is important to accurately focus optical or electromagnetic circuit patterns on the surface of the wafer. For example, as the density of integrated circuits increases, it is often necessary to accurately focus the critical dimensions of the photo-pattern to within a tolerance of approximately 0.1 $\mu$m. Focusing photo-patterns to such small tolerances, however, is very difficult when the surface of the substrate is not uniformly planar. Thus, to reduce the potential of fabricating defective devices, CMP processes must create highly uniform, planar surfaces on substrates.

In the competitive semiconductor industry, it is also desirable to maximize the throughput of the finished wafers and to minimize the number of defective or impaired devices on each wafer. The throughput of CMP processes is a function of several factors, one of which is the rate at which the thickness of the wafer decreases as it is being planarized (the "polishing rate"). Although high polishing rates are generally desirable, it is more difficult to control the planarity of the surface on the substrate at high polishing rates. Accordingly, it is desirable to maximize the polishing rate within controlled limits.

The polishing rate of conventional CMP processes may be increased by increasing the proportion of abrasive particles in the slurry solution. Yet, one problem with increasing the proportion of abrasive particles in colloidal slurry solutions is that the abrasive particles tend to flocculate when they are mixed with some desirable oxidizing and etching chemicals. Although stabilizing chemicals may prevent flocculation of the abrasive particles, the stabilizing chemicals are generally incompatible with the oxidizing and etching chemicals.

Thus, it may be necessary to limit the proportion of abrasive particles in the slurry solution.

Additionally, the polishing rate may vary across the face of a substrate because the slurry may not be distributed uniformly across the face of the substrate. In a typical CMP application, the perimeter of the substrate pushes the slurry across the polishing pad, thereby leaving less slurry under the center of the substrate. It will be appreciated that highly abrasive slurries produce even more disparate polishing rates across the substrate than relatively less abrasive slurries. Thus, it may also be necessary to limit the proportion of abrasive particles in the slurry solution to enhance the uniformity of the polishing rate across the substrate.

One desirable solution for limiting the proportion of abrasive particles in the slurry is to suspend the abrasive particles in the pad. Conventional suspended particle pads are made by admixing the abrasive particles into a matrix material made from monomer chains. An ionic adhesion catalyst, such as hexamethyldisalizane, may be used to enhance adhesion between the particles and the monomer chains. After the abrasive particles are mixed into the matrix material, the matrix material is cured to harden the pad and to suspend the abrasive particles throughout the matrix material. In operation, the suspended abrasive particles in the pad abrade the surface of the wafer to mechanically remove material from the wafer.

One problem with conventional suspended particle polishing pads is that the abrasiveness of the planarizing surface of the pad, and thus the polishing rate of a wafer, varies from one area to another across the surface of the pad. Before the matrix material is cured, the abrasive particles commonly agglomerate into high density clusters, causing a non-uniform distribution of abrasive particles in random patterns throughout the pad. Therefore, it would be desirable to develop a suspended particle polishing pad with a uniform distribution of abrasive particles throughout the pad or throughout different planarizing regions on the pad.

Another problem with conventional suspended particle polishing pads is that they may disadvantageously alter the surface of the substrate. As the pad planarizes a substrate, the matrix material adjacent to abrasive particles on the planarizing surface of the polishing pad wears down. As a result, some of the abrasive particles may eventually detach from the pad and travel in the slurry. Abrasive particles attached to the matix material with an ionic adhesion catalyst may also break away from a pad because electrostatic solvents used in slurries may weaken the ionic bonds between the matrix material and the particles. When a large agglomeration of suspended particles breaks away from the pad, it may disadvantageously alter the surface of the substrate. Therefore, it would be desirable to develop a pad that substantially prevents abrasive particles from detaching from the pad.

SUMMARY OF THE INVENTION

The inventive polishing pad is preferably used for planarizing semiconductor wafers or other substrates with a mechanical or CMP process. In one embodiment, the polishing pad preferably has a body made from a matrix material, bonding molecules bonded to the matrix material, and abrasive particles bonded to the bonding molecules. The bonding molecules are preferably covalently attached to the matrix material, and substantially all of the abrasive particles are preferably covalently bonded to at least one bonding molecule. The bonding molecules preferably affix the abrasive particles to the matrix material when the matrix material is uncured to inhibit the abrasive particles from agglomerating in the body. Thus, the polishing pad preferably has a substantially uniform distribution of the abrasive particles throughout the pad. The bonding molecules also preferably affix the abrasive particles to the matrix material in a manner that substantially inhibits the abrasive particles from detaching from the pad during planarization in the presence of an electrostatically stable CMP solution.

In one embodiment, the bonding molecules have an alkylene chain, a reactive terminus group at one end of the alkylene chain to covalently bond to the matrix material, and a particle affixing group at another end of the alkylene chain to covalently bond to abrasive particles. The reactive terminus group is preferably a COOH group that covalently bonds to urethane matrix materials. The particle affixing group is preferably a metal halide with an organic compound, such as trichlorosilane. The metal halide and organic compound particle affixing groups are preferably non-hydrolyzed groups that covalently bond with surface-pendant O—H groups on the surface of the abrasive particles. Accordingly, suitable materials from which the abrasive particles may be made include, but are not limited to, silicon dioxide, cerium oxide, aluminum oxide, tantalum oxide, and diamond.

The bonded particle polishing pads in accordance with the invention are preferably used to planarize semiconductor wafers or baseplates for field emission displays that have very small microelectronic components. In a preferred embodiment of the invention, the composition of the abrasive particles is selected according to the material being planarized from the surface of the substrate. One embodiment of the polishing pad, for example, preferably has silicon dioxide and/or cerium oxide abrasive particles to planarize doped or undoped silicon dioxide from the substrate. Another embodiment of the polishing pad preferably has aluminum oxide abrasive particles to planarize copper, aluminum, and/or tungsten from the substrate. In still another embodiment, an abrasive polishing pad preferably has tantalum oxide, silicon dioxide, or diamond abrasive particles to planarize silicon nitride from the substrate.

DETAILED DESCRIPTION OF THE INVENTION

The polishing pad of the present invention preferably has a uniform distribution of abrasive particles throughout the pad, and the abrasive particles are preferably covalently bonded to a matrix material to substantially prevent the abrasive particles from detaching from the pad. One aspect of an embodiment of the present invention is to provide molecular bonding links or bonding molecules that covalently bond to both the matrix material and the abrasive particles. The bonding molecules preferably perform the following advantageous functions: (1) substantially prevent the abrasive particles from agglomerating before the matrix material is cured; and (2) affix the abrasive particles to the matrix material with bonds that are chemically stable in the presence of a CMP slurry or other planarizing solution. The bonding molecules, therefore, preferably form bonds between the abrasive particles and the matrix material that can withstand the chemicals in the slurry to substantially prevent the abrasive particles from detaching from the polishing pad during planarization. FIGS. 2–6, in which like reference numbers identify like parts and features, illustrate embodiments of the invention.

Figure 1:
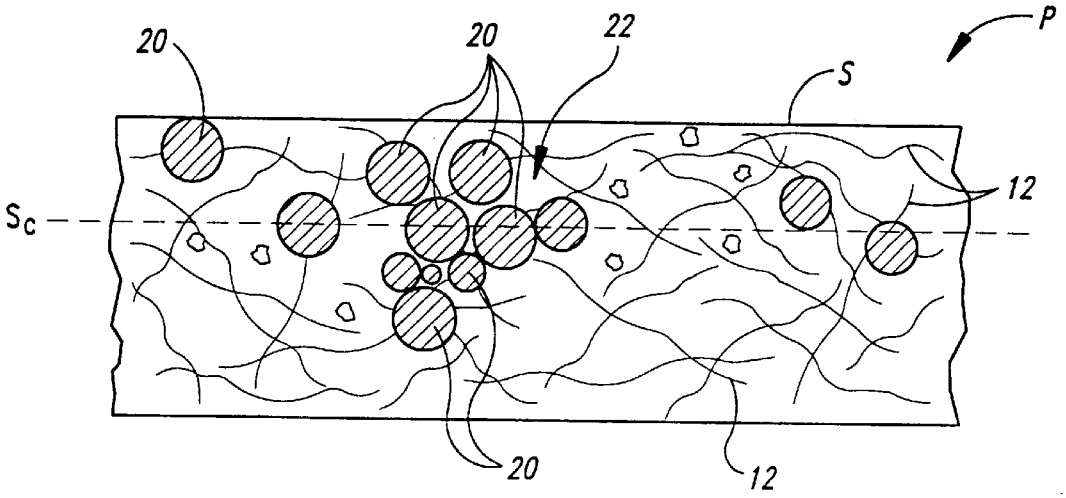
Fig. 1 (PRIOR ART)
FIG. 1 is a partial cross-sectional view of a conventional polishing pad with suspended abrasive particles in accordance with the prior art.

FIG. 1 illustrates a conventional polishing pad P formed from a matrix material 12 and a number of abrasive particles 20. The abrasive particles 20 are suspended in the matrix material 12 while the matrix material 12 is in a liquid state. Before the matrix material 12 cures, the abrasive particles 20 may agglomerate into clusters 22 that reduce the uniformity of the distribution of the abrasive particles 20 throughout the matrix material 12. Thus, when a planarizing surface S of the pad P is conditioned to a new planarizing surface $S_c$, the polishing rate over the cluster 22 of abrasive particles 20 is different than that of other areas on the pad. Thus, conventional suspended particle polishing pads may provide erratic polishing rates and damage the wafers.

Figure 2:
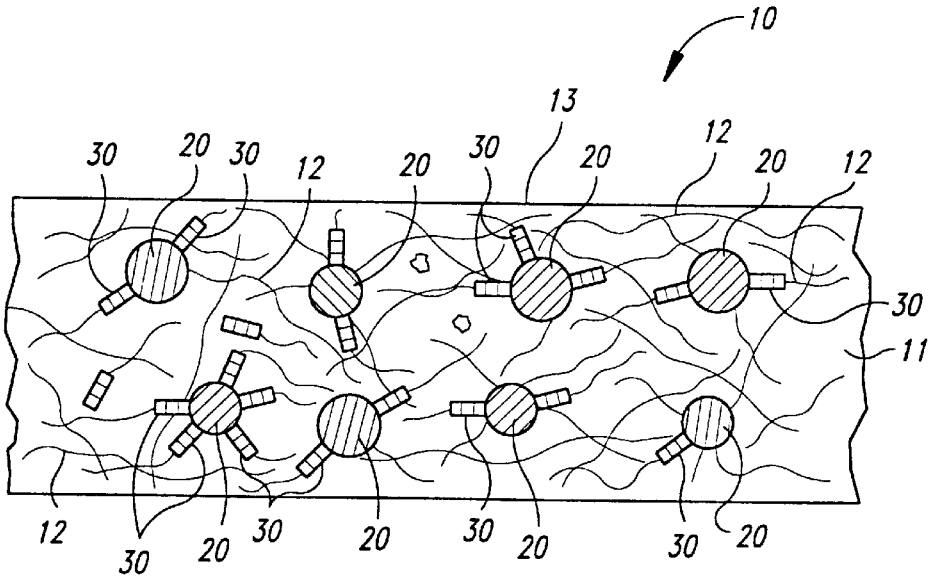
FIG. 2 is a partial schematic cross-sectional view of an embodiment of a polishing pad with bonded, suspended particles in accordance with the invention.

FIG. 2 is a partial cross-sectional view of an embodiment of a polishing pad 10 in accordance with the invention. The polishing pad 10 preferably has a body 11 made from a matrix material 12, abrasive particles 20 dispersed in the body 11, and bonding molecules 30 bonding the abrasive particles 20 to the matrix material 12. The matrix material 12 is generally polyurethane or nylon, but other polymeric matrix materials may also be within the scope of the invention. In a preferred embodiment, the bonding molecules or molecular bonding links 30 covalently bond to both the matrix material 12 and the abrasive particles 20. The bonding molecules 30, therefore, affix the abrasive particles 20 to the matrix material 12. The abrasive particles 20 are preferably made from silicon dioxide ($SiO_2$) or aluminum oxide ($Al_2O_3$), but other types of abrasive particles are within the scope of the invention. For example, the abrasive particles 20 may also be cerium oxide ($CeO_2$) or tantalum oxide ($Ta_2O_5$).

Figure 3:
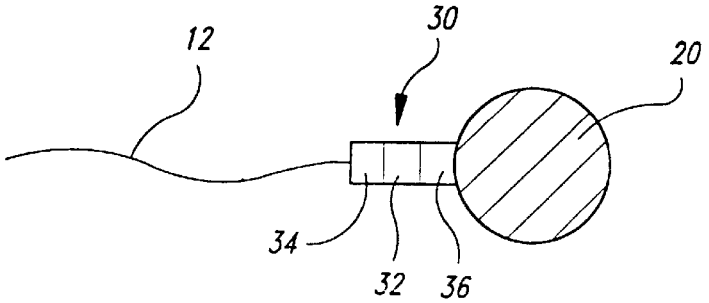
FIG. 3 is a schematic view of an embodiment of a bonding molecule and an abrasive particle in accordance with the invention.

FIG. 3 is a schematic view that further illustrates an embodiment of the bond between a strand of matrix material 12, a bonding molecule 30, and abrasive particle 20. The bonding molecule 30 preferably has an alkyl chain 32, a reactive terminus group 34 at one end of the alkyl chain 32, and a particle affixing group 36 at the other end of the alkyl chain. The reactive terminus group 34 is preferably a molecular segment that bonds the bonding molecule 30 to the strand of the matrix material 12. In a preferred embodiment, the specific structure of the reactive terminus group 34 is selected to covalently bond with the specific type of matrix material 12 when the matrix material 12 is in a liquid monomer phase. The particle affixing group 36 is preferably another molecular segment that bonds to the abrasive particle 20 to the bonding molecule 30. The preferred structure of the particle affixing group 36 is also selected to covalently bond with the material from which the abrasive particles 20 are made. In a preferred embodiment, therefore, the bonding molecules 30 interact with both the matrix material 12 and the abrasive particles 20 to securely affix the abrasive particles 20 to the matrix material 12.

Figure 4A:
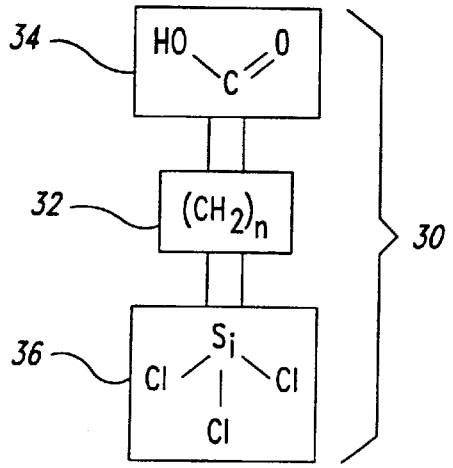
FIG. 4A is a chemical diagram of an embodiment of a bonding molecule and abrasive particle in accordance with the invention.
Figure 4A:
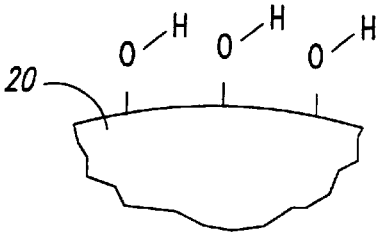
Figure 4B:
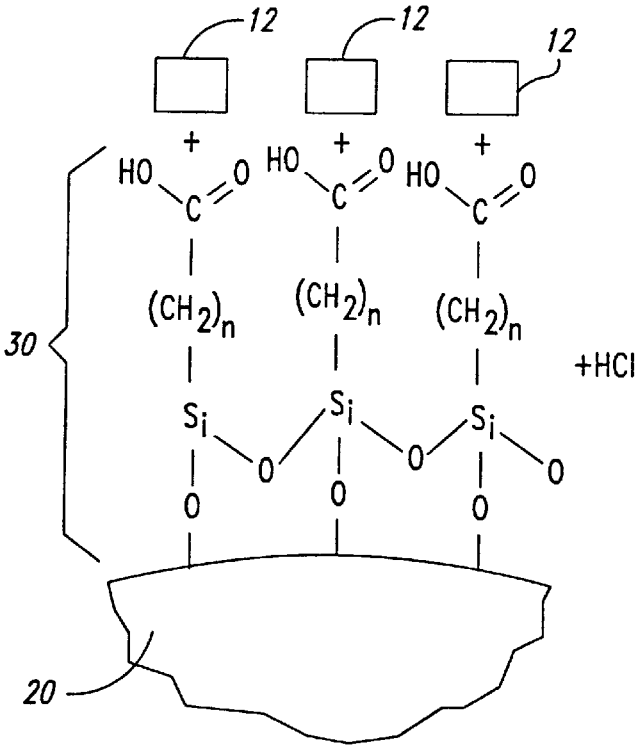
FIG. 4B is a chemical diagram of the reaction between the bonding molecule and the abrasive particle of FIG. 4A.

FIGS. 4A and 4B are chemical diagrams that illustrate a specific embodiment of the bonding molecule 30. In this embodiment, the alkyl chain 32 is an alkylene made from $(CH_2)_n$, where n=1–30, the reactive terminus group 34 is made from COOH, and the particle affixing group 36 is made from trichlorosilane. Referring to FIG. 4B, the COOH reactive terminus group 34 reacts with a urethane monomer chain 12 to bond the bonding molecule 30 to the matrix material 12. Similarly, the trichlorosilane molecule 36 reacts with the surface-pendent O—H chains on the abrasive particles 20 to covalently bond the abrasive particle 20 to the particle affixing group 36. The byproducts of the reaction are accordingly water and hydrochloric acid. The trichlorosilane particle affixing group 36 is preferably not hydrolyzed so that it forms a silicon-oxygen bond between the bonding molecule 30 and the abrasive particle 20 that is stable in ammonia or potassium planarizing solutions with pH levels of approximately 3.0 to 5.0. Thus, the particle affixing group is preferably a non-hydrolyzed molecule segment.

The invention is not limited to abrasive particles made from silicon dioxide or a matrix material made from polyurethane. The materials from which the abrasive particles and the matrix material are made can be varied to impart desired characteristics to the pad. An aspect of a preferred embodiment of the invention is to select bonding molecules that covalently bond to the abrasive particles and matrix material in a manner that substantially prevents the bonds between the matrix material, the bonding molecules, and the abrasive particles from weakening in the presence of an electrostatic solvent. In a preferred embodiment of the invention, therefore, a substantial percentage of the abrasive particles 20 remain attached to the matrix material during planarizing in planarizing solutions or slurries that dissolve or destabilize bonds between oligomer-pendant hydroxyl groups and surface-pendant hydroxyl groups.

Additionally, the length of the alkyl chain 32 of the bonding molecule 30 and the size of the abrasive particles 20 may be varied to impart different polishing characteristics to the pad 10. For example, an alkyl chain 15–20 Å in length (approximately twelve carbon atoms $(CH_2)_{12}$) may be used with a 1,500 Å diameter particle. Relatively long alkyl chains 32 are preferably used with larger abrasive particles 20 having a particle size of approximately 0.1–0.50 $\mu$m, and relatively short alkyl chains 32 are preferably used with smaller abrasive particles 20 having a particle size of approximately 0.05–0.10 $\mu$m.

One advantage of an embodiment of the present invention is that the polishing pad may produce a high, controlled polishing rate without limiting the oxidizing or etching chemicals in the slurry. By putting the abrasive particles 20 in the pad 10, stabilizing agents are not required in the slurry or other planarizing solution. Accordingly, a relatively high proportion of abrasive particles may be used to planarize a substrate without adversely impairing the types of etching and oxidizing chemicals that may be used in the slurry solution. Thus, a preferred embodiment of the invention may provide more flexibility in selecting chemical and mechanical planarizing materials Another advantage of an embodiment of the present invention is that the polishing pad 10 improves the uniformity of the polishing rate across the face of a substrate. By bonding the abrasive particles 20 to the matrix material 12, the abrasive particles 20 do not agglomerate into large clusters 22 within the pad (shown in FIG. 1). A preferred embodiment of the polishing pad 10, therefore, has a substantially uniform distribution of abrasive particles 20 throughout the matrix material. Also, because the abrasive particles 20 are bonded to the matrix material 12, the distribution of abrasive particles under the substrate is not affected by the distribution of slurry or planarizing solution across the face of the wafer. Thus, a preferred embodiment of the polishing pad 10 provides a substantially uniform polishing rate across the surface of the substrate.

Still another advantage of an embodiment of the invention is that the polishing pad 10 is not as likely to alter the surface of a wafer compared to conventional suspended particle polishing pads. By covalently bonding the abrasive particles 20 to the matrix material 12 with an appropriate particle affixing group 36, the abrasive particles 20 do not readily break away from the pad 10 in the presence of an electrostatic planarizing solution or slurry. Thus, compared to conventional pads, large clusters 22 of abrasive particles 20 are less likely to break away from the pad 10.

Figure 5A:
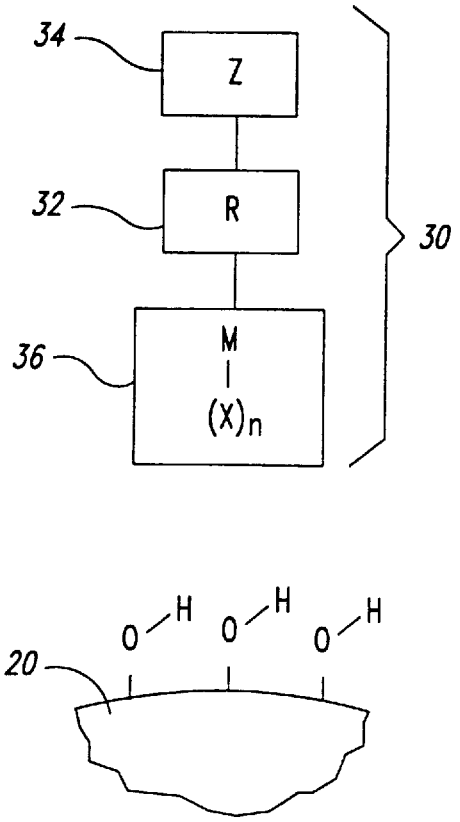
FIG. 5A is a chemical diagram of another embodiment of a bonding molecule and an abrasive particle in accordance with the invention.
Figure 5B:
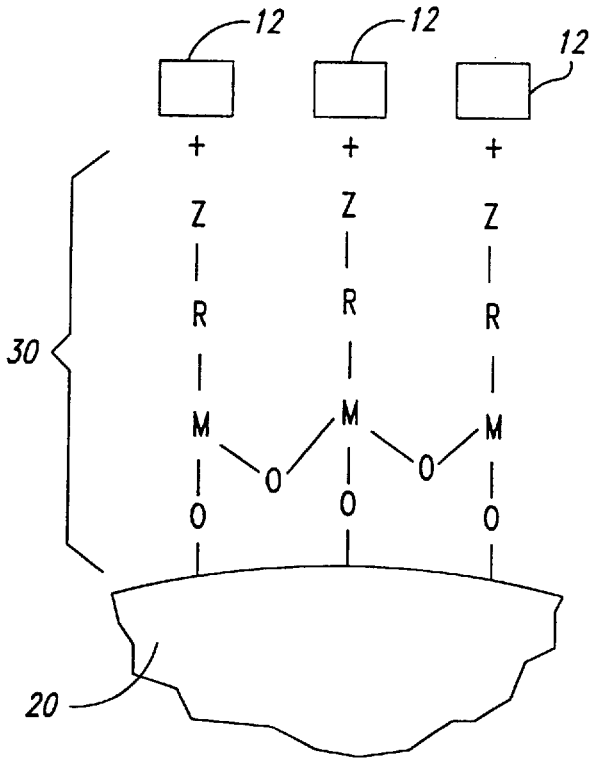
FIG. 5B is a chemical diagram of the reaction between the bonding molecule and the abrasive particle of FIG. 5A.

FIGS. 5A and 5B are chemical diagrams of other embodiments of abrasive particles 20 and bonding molecules 30 that form covalent bonds to sufficiently affix the abrasive particles 20 the matrix material 12. In addition to the silicon dioxide ($SiO_2$) and aluminum oxide ($Al_2O_3$) abrasive particles described above, the abrasive particles 20 may also be made from cerium oxide ($CeO_2$) and tantalum oxide ($Ta_2O_5$). The abrasive particles 20, therefore, are preferably any oxide particles with the surface-pendent OH groups. Furthermore, the chain 32 is preferably an alkylene R, the reactive terminus group 34 is preferably a reactive functional group Z, and the particle affixing group 36 is preferably a metal halide M with an organic compound $(X)_n$. For example, the reactive terminus group 34 is more preferably a carbolic acid or activated esters thereof, hydroxyl, amino, and thiol. Similarly, the metal M of the particle affixing group 36 is preferably a metal selected from the group consisting of Groups 2–15, and more preferably silicon, germanium or tin. Accordingly, the organic compounds $(X)_n$ are preferably chlorine, fluorine, bromine, and iodine, where n is generally an integer from 1 to 5 to satisfy the valence of the specific metal M. Suitable particle fixing groups 36 and corresponding abrasive particles 20 are as follows:

| Particle Affixing Group | Abrasive Particles |
|---|---|
| $SiCl_3$ | $(SiO_2)$, $(Al_2O_3)$, $(CeO_2)$, $(Ta_2O_5)$ |
| $SiF_n$ | $(SiO_2)$, $(Al_2O_3)$, $(CeO_2)$, $(Ta_2O_5)$ |
| $SiBr_n$ | $(SiO_2)$, $(Al_2O_3)$, $(CeO_2)$, $(Ta_2O_5)$ |
| $SiI_n$ | $(SiO_2)$, $(Al_2O_3)$, $(CeO_2)$, $(Ta_2O_5)$ |
| $GeCl_n$ | $(SiO_2)$, $(Al_2O_3)$, $(CeO_2)$, $(Ta_2O_5)$ |
| $GeF_n$ | $(SiO_2)$, $(Al_2O_3)$, $(CeO_2)$, $(Ta_2O_5)$ |
| $GeBr_n$ | $(SiO_2)$, $(Al_2O_3)$, $(CeO_2)$, $(Ta_2O_5)$ |
| $GeI_n$ | $(SiO_2)$, $(Al_2O_3)$, $(CeO_2)$, $(Ta_2O_5)$ |
| $SnCl_n$ | $(SiO_2)$, $(Al_2O_3)$, $(CeO_2)$, $(Ta_2O_5)$ |
| $SnF_n$ | $(SiO_2)$, $(Al_2O_3)$, $(CeO_2)$, $(Ta_2O_5)$ |
| $SnBr_n$ | $(SiO_2)$, $(Al_2O_3)$, $(CeO_2)$, $(Ta_2O_5)$ |
| $SnI_n$ | $(SiO_2)$, $(Al_2O_3)$, $(CeO_2)$, $(Ta_2O_5)$ |

Another aspect of a preferred embodiment of the polishing pad 10 is that the abrasiveness of the planarizing surface may be controlled to optimize the planarization of the substrate. The abrasiveness of the polishing pad 10 may be controlled by the particle size of the abrasive particles 20 at the planarizing surface of the pad 10. The abrasive particles 20 preferably have an average particle size of between 0.05 $\mu$m and 0.5 $\mu$m, and more preferably between approximately 0.08 μm and 0.12 μm. A polishing pad 10 with abrasive particles 20 having an average size of between approximately 0.12 μm and 0.5 μm is preferably used to planarize a blanket film from a substrate or to planarize a substrate with large step-heights. A polishing pad 10 with abrasive particles 20 having an average particle size of between 0.05 μm and 0.08 μm is preferably used as a final buff to enhance the planarity and smoothness of the planarized surface on the substrate. Accordingly, a polishing pad 10 with abrasive particles 20 having an average particle size of between approximately 0.08 μm and 0.12 μm is preferably used in most planarizing applications because such intermediate particle sizes provide a consistent, controllable polishing rate and a smooth surface on the substrate.

In addition to the particle size, the abrasiveness of the polishing pad may be controlled by the material from which the abrasive particles 20 are made. In general, silicon dioxide, cerium oxide and diamond particles are very hard and are used for highly abrasive polishing pads. Conversely, aluminum oxide and tantalum oxide are used for lesser abrasive pads. The abrasive particles 20 in the polishing pad may be made from a single material, or different abrasive particles of different materials may be used in the same pad. Thus, the composition of the abrasive particles provides a significant degree of flexibility in controlling the abrasiveness of the polishing pad.

Figure 6:
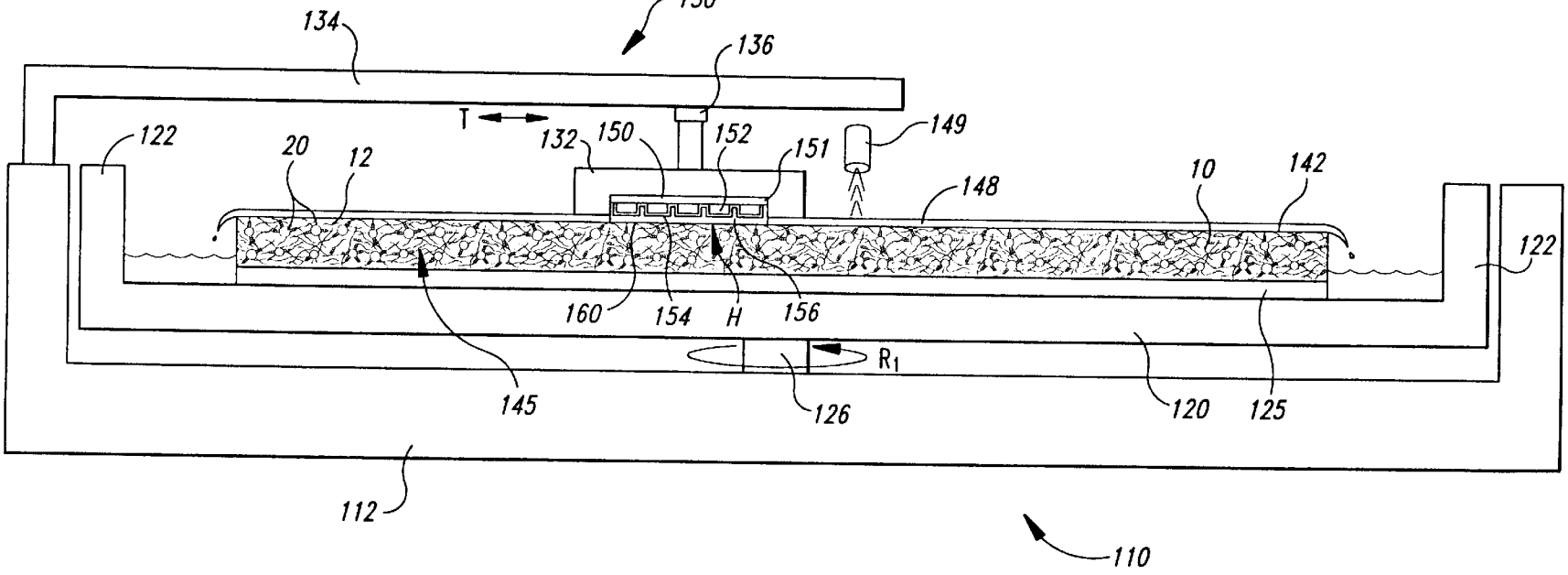
FIG. 6 is a schematic cross-sectional view of an embodiment of a planarization machine in accordance with the invention.

FIG. 6 is a schematic cross-sectional view of an embodiment of a planarizing machine 110 with a polishing pad 10 for mechanical or chemical-mechanical planarization of a substrate 150 in accordance with the invention. The planarizing machine 110 preferably has a housing 112, a platen 120 attached to the housing 112, and a wafer carrier assembly 130 that holds and moves a wafer carrier or chuck 132 over the platen 120. An underpad is preferably attached to the platen 120, and a polishing pad 10 in accordance with the invention is preferably attached to the underpad 125. The platen 120 is generally attached to an actuator 126 that moves the platen 120, and the substrate carrier 132 is generally attached to a substrate actuator 136 that moves the substrate carrier 132. In a preferred embodiment, the substrate actuator rotates the substrate carrier 132 and moves the substrate carrier 132 along an arm 134 extending over the platen 120 (indicated by arrow T) to move the substrate 150 across the polishing pad 10.

In operation of the planarizing machine 110, a planarizing liquid 148 dispensed through a dispenser 149 covers at least a portion of a planarizing surface 142 of the polishing pad 10. The planarizing liquid 148 preferably has chemicals that react with one or more layers of material on the substrate 150 to enhance the removal of such layers from the substrate. The planarizing liquid 148 may also have abrasive particles to abrade the surface of the substrate 150. In general, a particle-free planarizing liquid 148 is preferably used with the polishing pad 10, but an abrasive planarizing solution 148 (slurry) may also be used on the polishing pad 10. The planarizing liquid 148 generally flows radially outwardly across the polishing pad 10, and thus the platen 120 preferably has a sidewall 122 spaced radially outwardly from the polishing pad to catch the byproducts of the CMP process as they flow off of the polishing pad 10.

The polishing pad 10 and the planarizing liquid 148 define a polishing medium to remove material from the substrate 150. In one application of the planarizing machine 110, the substrate 150 may be a semiconductor wafer, a baseplate for a field emission display, or another type of substrate that requires a highly uniformly planar surface. For example, as shown in FIG. 6, the substrate 150 may be a semiconductor wafer with a plurality of integrated circuit components 152 formed on a wafer substrate 151, an underlying conformal layer 154 formed over the integrated circuit components 152, and a cover layer 156 formed over the underlying layer 154. The underlying layer 154 is preferably a polish-stop layer made from silicon nitride or another material with a relatively low polishing rate. The cover layer 56 is preferably an inter-dielectric layer made from borophosphate silicon glass (BPSG), tetraethylorthosilicate glass (TEOS), or any other suitable insulative material. In another embodiment (not shown), the substrate 150 may be a semiconductor wafer in which the underlying layer 154 is an inter-layer dielectric with vias formed over the components 152, and the cover layer 156 is a conductive layer deposited into the vias and over the underlying layer 154 to form contact plugs to the components 152. Suitable materials for a conductive cover layer 156 are copper, tungsten and aluminum. The planarizing machine 110, however, may be used to accurately polish other structures of semiconductor wafers, baseplates, and other substrates.

To planarize the substrate 150, the substrate carrier 132 preferably presses the surface of the substrate 150 against the polishing pad 10 in the presence of the planarizing solution 148. Since the composition of the abrasive particles 20 affects the abrasiveness of the pad 10, the composition of the abrasive particles 20 is preferably selected according to the type of material being removed from the substrate 150. In one embodiment, the abrasive particles 20 are preferably silicon dioxide and/or cerium oxide particles to planarize a cover layer 156 of doped or undoped silicon dioxide. In another embodiment, the abrasive particles 20 are preferably aluminum oxide particles to planarize a cover layer 156 of copper, tungsten, or aluminum. In still another embodiment, the abrasive particles 20 are preferably tantalum oxide or silicon dioxide particles to planarize a layer of silicon nitride. Accordingly, the composition of the abrasive particles 20 in a particular polishing pad 10 are preferably selected according to the type of material being removed from the substrate 150.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A substrate polishing pad, comprising:

a body made from a matrix material;

bonding molecules covalently bonded to the matrix material; and oxide abrasive particles covalently bonded to the bonding molecules in the body, wherein bonds between the bonding molecules and the abrasive particles are stable in the presence of planarization solutions to affix the abrasive particles to the matrix material during planarization of the substrate.

2. The polishing pad of claim 1 wherein each bonding molecule comprises:

a reactive terminus group at one end of the bonding molecule that covalently bonds to the matrix material; and a particle affixing group at another end of the bonding molecule that covalently bonds to an abrasive particle.

3. The polishing pad of claim 1 wherein the abrasive particles comprise silicon dioxide.

4. The polishing pad of claim 1 wherein the abrasive particles comprise aluminum dioxide.

5. The polishing pad of claim 1 wherein the abrasive particles comprises cerium oxide.

6. The polishing pad of claim 1 wherein the abrasive particles comprise tantalum oxide.

7. The polishing pad of claim 1 wherein the particle affixing groups of the bonding molecules comprise non-hydrolyzed molecules that covalently bond with hydrolyzed surface-pendent groups on the oxide particles.

8. The polishing pad of claim 1 wherein the matrix material comprises a polymeric material and the particle affixing group comprises a non-hydrolyzed metal halide with an organic group.

9. The polishing pad of claim 8 wherein the non-hydrolyzed metal halide with an organic group comprises trichlorosilane.

10. The polishing pad of claim 8 wherein the metal of the non-hydrolyzed metal halide with an organic group is selected from the group consisting of silicon, germanium and tin.

11. The polishing pad of claim 8 wherein the organic compound of the non-hydrolyzed metal halide with an organic group is selected from the group consisting of chlorine, fluorine, iodine and bromine.

12. The polishing pad of claim 8 wherein the abrasive particles comprise silicon oxide.

13. The polishing pad of claim 8 wherein the abrasive particles comprise aluminum oxide.

14. The polishing pad of claim 8 wherein the abrasive particles comprise cerium oxide.

15. The polishing pad of claim 8 wherein the abrasive particles comprise tantalum oxide.

16. The polishing pad of claim 1 wherein the abrasive particles comprise between approximately 1% and 50% by weight of the polishing pad.

17. The polishing pad of claim 1 wherein the abrasive particles comprise between approximately 10% and 25% by weight of the polishing pad.

18. The polishing pad of claim 1 wherein the abrasive particles comprise between approximately 15% and 20% by weight of the polishing pad.

19. The polishing pad of claim 1 wherein the abrasive particles have a particle size of approximately 0.05 $\mu$m to 1.0 $\mu$m.

20. The polishing pad of claim 1 wherein the abrasive particles have a particle size of approximately 0.08 $\mu$m to 0.12 $\mu$m.

21. The polishing pad of claim 1 wherein the abrasive particles have an average particle size of approximately 0.10 $\mu$m.

22. A substrate polishing pad, comprising:

a body made from a polymeric matrix material;

bonding molecules having an alkylene chain with a reactive terminus group at one end covalently bonded to the matrix material and a particle affixing group at another end; and silicon dioxide abrasive particles covalently bonded to the particle affixing groups of the bonding molecules, wherein bonds between the particle affixing groups and the abrasive particles are sufficiently stable in the presence of planarization solutions to maintain affixation between the abrasive particles and the matrix material during planarization.

23. The polishing pad of claim 22 wherein the particle affixing groups of the bonding molecules comprise non-hydrolyzed molecules that covalently bond with hydrolyzed surface-pendent groups on the silicon dioxide particles.

24. The polishing pad of claim 22 wherein each particle affixing group comprises a non-hydrolyzed metal halide with an organic group.

25. The polishing pad of claim 24 wherein the non-hydrolyzed metal halide with an organic group is trichlorosilane.

26. The polishing pad of claim 24 wherein the metal halide of the non-hydrolyzed metal halide with an organic group is selected from the group consisting of silicon, germanium and tin.

27. The polishing pad of claim 24 wherein the organic group of the non-hydrolyzed metal halide with an organic group is selected from the group consisting of chlorine, fluorine, bromine, and iodine.

28. The polishing pad of claim 22 wherein the silicon dioxide particles comprise between 1% and 50% of the polishing pad by weight.

29. The polishing pad of claim 22 wherein the silicon dioxide particle comprises between 1% and 50% of the polishing pad by volume.

30. The polishing pad of claim 22 wherein the silicon dioxide particles have an average particle size of 0.1 $\mu$m and less.

31. A substrate polishing pad, comprising:

a body made from a polymeric matrix material;

bonding molecules having an alkylene chain with a reactive terminus group at one end covalently bonded to the matrix material and a particle affixing group at another end; and aluminum oxide abrasive particles covalently bonded to the particle affixing groups of the bonding molecules, wherein bonds between the particle affixing groups and the aluminum oxide particles are sufficiently stable in the presence of planarization solutions to maintain affixation between the abrasive particles and the matrix material during planarization.

32. The polishing pad of claim 31 wherein the particle affixing groups comprise non-hydrolyzed molecules that covalently bond with non-hydrolyzed surface-pendent groups on the aluminum oxide particles.

33. The polishing pad of claim 31 wherein each particle affixing group comprises a non-hydrolyzed metal halide with an organic group.

34. The polishing pad of claim 33 wherein the non-hydrolyzed metal halide with an organic group is trichlorosilane.

35. The polishing pad of claim 33 wherein the metal halide of the non-hydrolyzed metal halide with an organic group is selected from the group consisting of silicon, germanium and tin.

36. The polishing pad of claim 33 wherein the organic group of the non-hydrolyzed metal halide with an organic group is of one from the group consisting of chlorine, fluorine, bromine, and iodine.

37. The polishing pad of claim 33 wherein the aluminum oxide particles comprise between 1% and 50% of the polishing pad by weight.

38. The polishing pad of claim 33 wherein the aluminum oxide particle comprises between 1% and 50% of the polishing pad by volume.

39. The polishing pad of claim 33 wherein the aluminum oxide particles have an average particle size of 0.1 $\mu$m and less.

40. A substrate polishing pad, comprising:

a body made from a polymeric matrix material;

bonding molecules having an alkylene chain with a reactive terminus group at one end covalently bonded to the matrix material and a particle affixing group at another end; and cerium oxide abrasive particles covalently bonded to the particle affixing groups of the bonding molecules, wherein bonds between the particle affixing groups and the cerium oxide particles are sufficiently stable in the presence of planarization solutions to maintain affixation between the abrasive particles and the matrix material during planarization.

41. The polishing pad of claim 40 wherein the particle affixing groups comprise non-hydrolyzed molecules that covalently bond with non-hydrolyzed surface-pendent groups on the cerium oxide particles.

42. The polishing pad of claim 40 wherein each particle affixing group comprises a non-hydrolyzed metal halide with an organic group.

43. The polishing pad of claim 42 wherein the non-hydrolyzed metal halide with an organic group is trichlorosilane.

44. The polishing pad of claim 42 wherein the metal halide of the non-hydrolyzed metal halide with an organic group is selected from the group consisting of silicon, germanium and tin.

45. The polishing pad of claim 42 wherein the organic group of the non-hydrolyzed metal halide with an organic group is of one from the group consisting of chlorine, fluorine, bromine, and iodine.

46. The polishing pad of claim 40 wherein the cerium oxide particles comprise between 1% and 50% of the polishing pad by weight.

47. The polishing pad of claim 40 wherein the cerium oxide particle comprises between 1% and 50% of the polishing pad by volume.

48. The polishing pad of claim 40 wherein the cerium oxide particles have an average particle size of 0.1 $\mu$m and less.

49. A substrate polishing pad, comprising:

a body made from a polymeric matrix material;

bonding molecules having an alkylene chain with a reactive terminus group at one end covalently bonded to the matrix material and a particle affixing group at another end; and tantalum oxide abrasive particles covalently bonded to the particle affixing groups of the bonding molecules, wherein bonds between the particle affixing groups and the tantalum oxide particles are sufficiently stable in the presence of planarization solutions to maintain affixation between the abrasive particles and the matrix material during planarization.

50. The polishing pad of claim 49 wherein the particle affixing groups comprise non-hydrolyzed molecules that covalently bond with non-hydrolyzed surface-pendent groups on the tantalum oxide particles.

51. The polishing pad of claim 49 wherein each particle affixing group comprises a non-hydrolyzed metal halide with an organic group.

52. The polishing pad of claim 51 wherein the metal halide of the non-hydrolyzed metal halide with an organic group is trichlorosilane.

53. The polishing pad of claim 51 wherein the organic group of the organic group of the non-hydrolyzed metal halide with an organic group is selected from the group consisting of silicon, germanium and tin.

54. The polishing pad of claim 51 wherein the non-hydrolyzed metal halide with an organic group is of one from the group consisting of chlorine, fluorine, bromine, and iodine.

55. The polishing pad of claim 49 wherein the tantalum oxide particles comprise between 1% and 50% of the polishing pad by weight.

56. The polishing pad of claim 49 wherein the tantalum oxide particle comprises between 1% and 50% of the polishing pad by volume.

57. The polishing pad of claim 49 wherein the tantalum oxide particles have an average particle size of 0.1 $\mu$m and less.

58. A planarizing machine for planarizing a substrate, comprising:

a support surface;

a polishing pad supported by the support surface, the polishing pad having a body made from a matrix material, bonding molecules in which each bonding molecule has a reactive terminus group for covalent bonding to the matrix material and a particle affixing group, and oxide abrasive particles covalently bonded to particle affixing groups of the bonding molecules, wherein bonds between the particle affixing groups and the abrasive particles maintain affixation between the abrasive particles and the particle affixing groups in the presence of planarizing solutions; and a substrate carrier positionable over the polishing pad, the substrate being attachable to the substrate carrier, wherein at least one of the substrate carrier and the polishing pad moves to engage the wafer with the polishing pad and to impart motion between the substrate and the polishing pad.

59. The planarizing machine of claim 58 wherein the particle affixing groups of the bonding molecules comprise non-hydrolyzed molecules that covalently bond with hydrolyzed surface-pendent groups of the oxide particles in the polishing pad.

60. The planarizing machine of claim 59 wherein the abrasive particles comprise silicon dioxide.

61. The planarizing machine of claim 59 wherein the abrasive particles comprise aluminum oxide.

62. The planarizing machine of claim 59 wherein the abrasive particles comprise cerium oxide.

63. The planarizing machine of claim 59 wherein the abrasive particles comprise tantalum oxide.

64. The planarizing machine of claim 59 wherein the particle affixing group comprises trichlorosilane.

65. The planarizing machine of claim 64 wherein the abrasive particles comprise silicon dioxide.

66. The planarizing machine of claim 64 wherein the abrasive particles comprise aluminum oxide.

67. The planarizing machine of claim 64 wherein the abrasive particles comprise cerium oxide.

68. The planarizing machine of claim 64 wherein the abrasive particles comprise tantalum oxide.

69. A method of planarizing a substrate, comprising the step of removing material from the substrate with a polishing pad having a body made from a polymeric matrix material, bonding molecules having at least one reactive terminus group for covalent bonding to the matrix material and at least one particle affixing group, and abrasive particles covalently bonded to particle affixing groups of the bonding molecules, wherein bonds between the particle affixing groups and the abrasive particles are stable in the presence of planarization solutions to affix the abrasive particles to the matrix material.

70. The method of claim 69 wherein the removing step further comprises pressing the substrate against the polishing pad and moving at least one of the substrate and the polishing pad with respect to the other to impart relative motion therebetween.

71. The method of claim 69 wherein the removing step further comprises:

depositing a planarizing solution on the polishing pad;

pressing the substrate against the polishing pad in the presence of the planarizing solution; and moving at least one of the substrate and the polishing pad with respect to the other to impart relative motion therebetween.

72. The method of claim 71 wherein abrasive particles comprise silicon oxides and the substrate has a surface layer of a metal oxide, and wherein the moving step comprises abrading the cover layer with the abrasive particles.

73. The method of claim 71 wherein the abrasive particles comprise cerium oxide and the substrate has a cover layer of a silicon oxide, and wherein the moving step comprises abrading the cover layer with the abrasive particles.

74. The method of claim 71 wherein the abrasive particles comprise aluminum oxide and the substrate has a metal cover layer, and wherein the moving step comprises abrading the cover layer with the abrasive particles.

75. The method of claim 74 wherein the metal cover layer at least one selected from the group consisting of copper, tungsten, aluminum and gold.

76. The method of claim 71 wherein the abrasive particle comprise tantalum oxide and the substrate has a silicon nitride cover layer, and wherein the moving step comprises abrading the cover layer with the abrasive particles.

77. The method of claim 71 wherein the abrasive particles comprise approximately 5% to 30% of the polishing pad by weight, and the moving step comprises abrading the substrate with at least a portion of the abrasive particles at a planarizing surface of the polishing pad.

78. The method of claim 71 wherein the abrasive particles have an average particles size of approximately 0.08 $\mu$m to 0.12 $\mu$m, and the moving step comprises abrading the substrate with at least a portion of the abrasive particles at a planarizing surface of the polishing pad.

79. A method of planarizing a substrate, comprising the steps of:

pressing the substrate on a polishing pad having a body made from a polymeric matrix material, bonding molecules having at least one reactive terminus group for covalent bonding to the matrix material and at least one particle affixing group, and abrasive particles covalently bonded to particle affixing groups of the bonding molecules, wherein bonds between the particle affixing groups and the abrasive particles are stable in the presence of planarization solutions to affix the abrasive particles to the matrix material; and moving at least one of the substrate and the polishing pad with respect to the other to impart relative motion therebetween.

80. A method of planarizing a substrate, comprising the step of abrading material from the substrate with a polishing pad having a body made from a polymeric matrix material, bonding molecules having at least one reactive terminus group for covalent bonding to the matrix material and at least one particle affixing group, and abrasive particles covalently bonded to particle affixing groups of the bonding molecules, wherein bonds between the particle affixing groups and the abrasive particles are stable in the presence of planarization solutions to affix the abrasive particles to the matrix material.

* * * * *